US007501568B2

(12) United States Patent
Uehara

(10) Patent No.: US 7,501,568 B2
(45) Date of Patent: Mar. 10, 2009

(54) MUSICAL PERFORMANCE SYSTEM, MUSICAL INSTRUMENT INCORPORATED THEREIN AND MULTI-PURPOSE PORTABLE INFORMATION TERMINAL DEVICE FOR THE SYSTEM

(75) Inventor: Haruki Uehara, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 245 days.

(21) Appl. No.: 11/487,784

(22) Filed: Jul. 17, 2006

(65) Prior Publication Data

US 2007/0017349 A1 Jan. 25, 2007

(30) Foreign Application Priority Data

Jul. 19, 2005 (JP) ..... 2005-208651

(51) Int. Cl.
*G10H 1/00* (2006.01)

(52) U.S. Cl. ..... 84/600; 84/602

(58) Field of Classification Search ..... 84/600–609
See application file for complete search history.

(56) References Cited

U.S. PATENT DOCUMENTS

| | | | | |
|---|---|---|---|---|
| 4,099,437 | A * | 7/1978 | Stavrou et al. | 84/617 |
| 4,437,378 | A * | 3/1984 | Ishida et al. | 84/609 |
| 5,231,488 | A * | 7/1993 | Mohrbacher et al. | 348/184 |
| 5,406,024 | A * | 4/1995 | Shioda | 84/622 |
| 5,446,791 | A * | 8/1995 | Wooley et al. | 381/118 |
| 6,046,394 | A * | 4/2000 | Hino | 84/477 R |
| 6,072,114 | A * | 6/2000 | Kunimasa | 84/477 R |
| 6,137,041 | A * | 10/2000 | Nakano | 84/470 R |
| 7,224,903 | B2 * | 5/2007 | Colmenarez et al. | 398/106 |
| 2004/0055443 | A1 | 3/2004 | Nishitani et al. | |
| 2004/0261606 | A1 | 12/2004 | Suzuki et al. | |
| 2005/0092160 | A1 * | 5/2005 | Fujiwara | 84/600 |
| 2005/0188821 | A1 * | 9/2005 | Yamashita et al. | 84/611 |
| 2005/0262548 | A1 * | 11/2005 | Shimojo et al. | 725/135 |
| 2006/0032364 | A1 * | 2/2006 | Ludwig | 84/723 |
| 2007/0113727 | A1 * | 5/2007 | Ganley et al. | 84/625 |

(Continued)

FOREIGN PATENT DOCUMENTS

| | | |
|---|---|---|
| GB | 2408128 | 5/2005 |

(Continued)

OTHER PUBLICATIONS

Yamaha Corp: "Tablet Controller Operating Manual" Disklavier Mark IV Series, 2004, XP002403622 (9 pages).

*Primary Examiner*—David S. Warren
(74) *Attorney, Agent, or Firm*—Harness, Dickey & Pierce, PLC

(57) ABSTRACT

A hybrid musical instrument and a PDA form a musical performance system, and a user controls the hybrid musical instrument by means of the PDA; when the user pairs the hybrid musical instrument with the PDA, the musical instrument converts an identification code to a machine-recognizable image such as an image of a QR code on a monitor display, and the PDA takes in the image of QR code through an image pickup device; the PDA restores the image of QR code to the identification code, and stores it in a memory; and the identification code is directly transmitted from the hybrid musical instrument to the PDA without any keying-in so that the user feels the pairing work easy and speedy.

20 Claims, 12 Drawing Sheets

U.S. PATENT DOCUMENTS

2007/0138289 A1* 6/2007 Melick et al. ..... 235/462.41
2007/0256551 A1* 11/2007 Knapp et al. ..... 84/722

FOREIGN PATENT DOCUMENTS

GB 2412265 9/2005
JP 2002-341864 A 11/2002
JP 2003 169187 6/2003
JP 2006 043900 2/2006

* cited by examiner

MUSICAL PERFORMANCE SYSTEM, MUSICAL INSTRUMENT INCORPORATED THEREIN AND MULTI-PURPOSE PORTABLE INFORMATION TERMINAL DEVICE FOR THE SYSTEM

FIELD OF THE INVENTION

This invention relates to a musical performance system and, more particularly, to a musical performance system for playing tunes, a musical instrument forming a part of the musical performance system and a multi-purpose portable information terminal device for communicating with the musical instrument without disturbance of another electronic device.

DESCRIPTION OF THE RELATED ART

Performers play tunes on acoustic musical instruments for audience or their fun. Modern musical instruments offer another sort of pleasure to the performers. A performer records his or her performance on the musical instrument, and, thereafter, instructs the musical instrument to reenact the performance. Otherwise, a performer plays a tune on a musical instrument with the accompaniment of another musical instrument such as, for example, an electronic percussion instrument. An automatic player piano, mute piano and automatic player mute piano are designed to reenact the performance through acoustic piano tones or electronic tones, and are categorized in a hybrid musical instrument. Several models of hybrid musical instruments can electronically produce percussion sound for the accompaniment independently of the fingering of human players on the hybrid musical instruments. A performer may play a tune on an acoustic stringed instrument to the accompaniment of an electronic musical instrument such as, for example, an electronic keyboard or an electronic percussion instrument. A string-less keyboard musical instrument, which is disclosed in Japanese Patent Application laid-open No. Hei 5-80750, is also available for the accompaniment.

Any human performer is not required for the automatic playing and accompaniment. An electronic system is incorporated in the hybrid musical instrument and electronic musical instrument, and the performer instructs the electronic system to reenact the original performance or accompany his or her performance. Smooth communication with the hybrid musical instrument or electronic musical instrument is required for the automatic playing and accompaniment. For this reason, the electronic system provides a man-machine interface to users.

A typical example of the man-machine interface is a manipulating panel. Switches, dials, levers and keys are arranged on a frame, and users give their instructions to the electronic system through the switches, dials, levers and keys. The manipulating panel is usually provided on the cabinet of the musical instrument. In case where a user sits on a stool in front of the musical instrument, he or she does not feel the manipulating panel inconvenient. However, if the user is remote from the musical instrument for the automatic playing or accompaniment, he or she wishes to communicate with the musical instrument by means of a remote controller. The user gives his or her instruction to the musical instrument through the wireless communication between the remote controller and the electronic system. The musical instrument, which is equipped with the electronic system, and remote controller form in combination a prior art musical performance system.

A typical example of the remote controller is of the type connecting electronic devices through a radio system. Recently, there is proposed to use an information terminal device such as a PDA (Personal Digital Assistants) and a tablet as the remote controller. The information terminal device form a wireless LAN (Local Area Network) together with the electronic systems incorporated in the musical instruments, and is directly communicable with the electronic system of the musical instrument through a radio channel. Thus, the information terminal device can communicate with another electronic device as if another electronic device serves as one of the access points.

In order to communicate with the electronic system of the musical instrument, it is firstly necessary to pair the remote controller with the electronic system of a target musical instrument. There are known two pairing techniques.

1. The first paring technique is manually to achieve the pairing between electronic devices by a user, and is hereinafter referred to as "manually pairing technique".
2. The second pairing technique is automatically to achieve the pairing between electronic devices with the assistance of a computer program, and is hereinafter referred to as "automatically pairing technique".

As well know to persons ordinary skilled in the art, a piece of identification information such as an ESSID (Extended Service Set IDentifier) code is required for the wireless LAN, and an identification code permits electronic devices to be paired with one another in the wireless LAN. In case where the manually pairing technique is employed in a remote controller, the user manually inputs the identification code of the electronic system of a target musical instrument by pushing keys or images of keys. On the other hand, if the automatically pairing technique is employed in a remote controller, the user makes a search program run on an information processor in the remote controller, and the search program assists the user to find an access point closest to the user.

The prior art musical performance system is designed on the assumption that the remote controller exclusively communicates with the electronic system of a musical instrument. In other words, any pairing technique is not taken into account. The exclusively used remote controller is inconvenient to users, who have already given instructions to electronic products around them by means of other exclusively used remote controllers. In this situation, a portable information device such as the PDA is convenient to them, because the portable information device permits the users selectively to communicate with electronic devices for various purposes.

The portable information device has been employed in prior art musical performance systems as the remote controller. The users use their portable information devices, which they have already owned, as the remote controller for musical instruments. However, a problem is encountered in the prior art musical performance systems in that the users feel the pairing work troublesome.

In detail, in case where the manually pairing technique is employed, the users hate to push the keys or images of keys for the identification code. The repetition of keying-in per se is troublesome. Moreover, the users sometimes fail to exactly input the identification code into the portable information device. In this situation, the users need correctly to input the identification code through the repetition of keying-in, and feel the keying-in troublesome. Thus, the users hate the manually pairing technique.

On the other hand, in case where the automatically pairing technique is employed, the portable information device sometimes establishes the wireless channel to another electronic device in the environment where a lot of access points surround together with the electronic system of the musical instrument. In this situation, the user needs to power off the other access points, and feels the automatic pairing work also troublesome. Such an undesirable environment is further found in hotels, music shops, exhibitions of musical instruments and factories for hybrid musical instruments.

SUMMARY OF THE INVENTION

It is therefore an important object of the present invention to provide a musical performance system, which permits a user easily to pair a multi-purpose remote controller with an electronic system of a target musical instrument.

It is also an important object of the present invention to provide a musical instrument, which forms a part of the musical performance system.

It is another important object of the present invention to provide a multi-purpose portable information terminal device, which forms a part of the musical performance system.

To accomplish the object, the present invention proposes to transfer a machine-recognizable image expressing an identifier assigned to a musical instrument to a portable information terminal device.

In accordance with one aspect of the present invention, there is provided a musical performance system for producing music sound comprising at least one musical instrument including a tone generator producing the music sound and a controller converting an identifier assigned to the aforesaid at least one musical instrument to an machine-recognizable image, outputting the machine-recognizable image to the outside thereof, communicable through a wireless channel so as to receive an instruction and controlling the tone generator on the basis of the instruction for producing the music sound, and a portable information terminal device taking in the machine-recognizable image, restoring the machine-recognizable image to the identifier and establishing the wireless channel in the musical performance system so as to transmit the instruction labeled with the identifier to the controller.

In accordance with another aspect of the present invention, there is provided a musical instrument forming a part of a musical performance system together with a portable information terminal device, and the musical instrument comprises a tone generator producing music sound and a controller converting an identifier assigned to the musical instrument to an machine-recognizable image, outputting the machine-recognizable image to the outside thereof, communicable through a wireless channel with the portable information terminal device so as to receive an instruction labeled with the identifier restored from the machine-recognizable image in the portable information terminal device and controlling the tone generator on the basis of the instruction for producing the music sound.

In accordance with yet another aspect of the present invention, there is provided a portable information terminal device forming a part of a musical performance system together with at least one musical instrument having a controller, and the portable information terminal device comprises an image pickup device taking in a machine-recognizable image representative of an identifier assigned to the aforesaid at least one musical instrument and output from the aforesaid at least one musical instrument, a converter restoring the machine-recognizable image to the identifier and a communication device establishing a wireless channel in the musical performance system so as to transmit an instruction labeled with the identifier to the controller, whereby a user controls the aforesaid at least one musical instrument.

BRIEF DESCRIPTION OF THE DRAWINGS

The features and advantages of the musical performance system, musical instrument and multi-purpose portable information terminal will be more clearly understood from the following description taken in conjunction with the accompanying drawings, in which.

DESCRIPTION OF THE PREFERRED EMBODIMENTS

Figure 1:
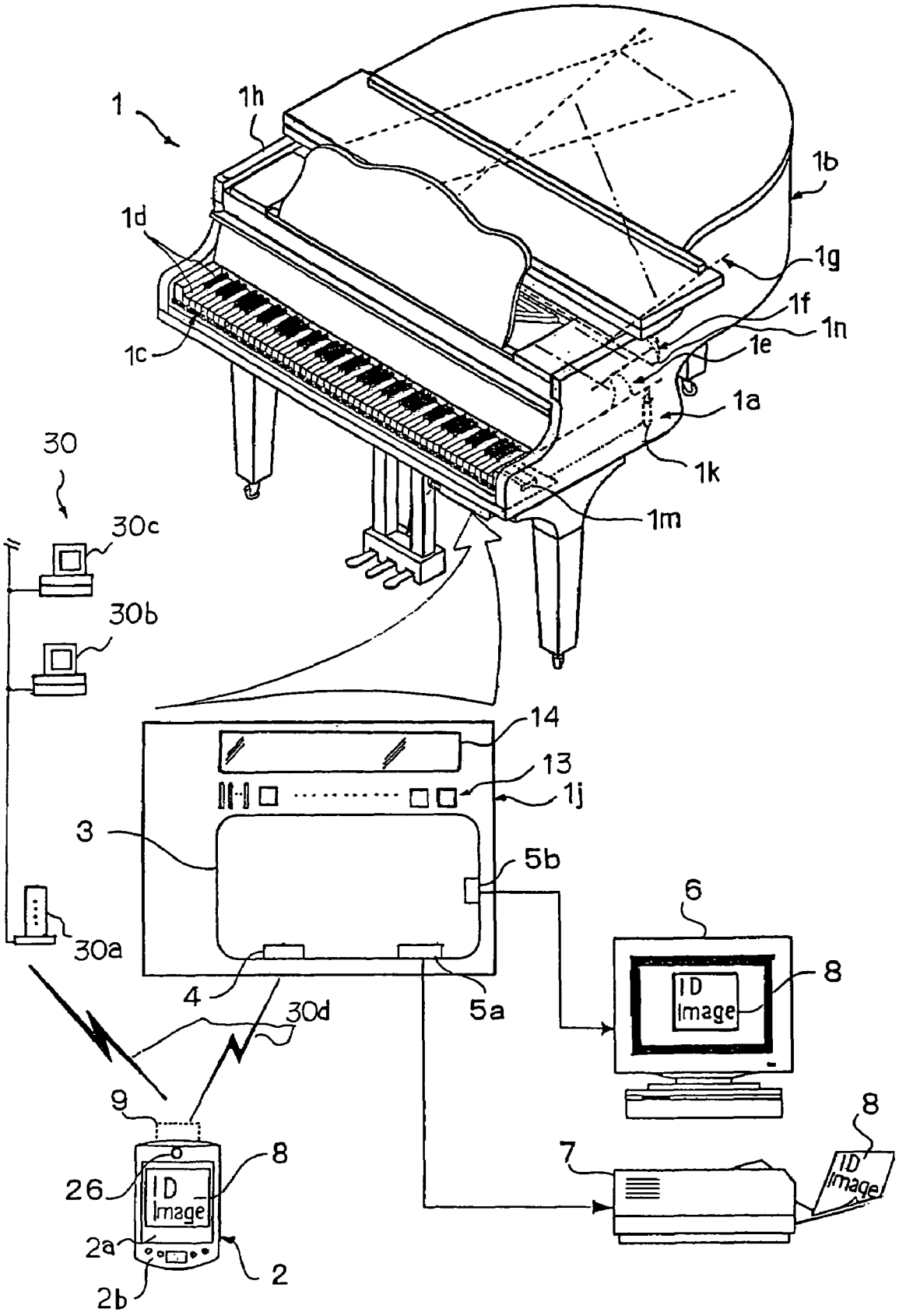
FIG. 1 is a schematic view showing the system configuration of a musical performance system of the present invention.

A musical performance system embodying the present invention is prepared for producing music sound. The musical performance system largely comprises at least one musical instrument and a portable information terminal device. More than one musical instrument may be incorporated in the musical performance system. A user, who is remote from the musical instrument, controls the musical instrument by means of the portable information terminal device through a wireless channel. Since the portable information terminal device is designed for a general-purpose data processing and non-exclusive information transmission, the musical instrument and portable information terminal device are to be discriminate pieces of data information therebetween from other pieces of data information sent to another destination. For the discrimination purpose, the pieces of data information therebetween are labeled with an identifier assigned to the musical instrument. Although the identifier has been stored in the musical instrument, the identifier is to be transferred to the portable information terminal device. In order to prevent the portable information terminal device from human errors, it is desirable to transfer the identifier to the portable information terminal device without any participation of human being. For this reason, the identifier is converted to a machine-recognizable image, and the machine-recognizable image is directly transmitted from the musical instrument to the portable information terminal device.

In detail, the musical instrument includes a tone generator and a controller. The tone generator produces music sound such as tones produced along a music passage or beats. The controller is connected to the tone generator, and controls the tone generator for producing tones and/or percussion sound. A user is assumed to instruct the controller to produce tones along a music passage. The controller specifies the pitch of tones to be produced, timing at which each tone rises and timing at which the tone is decayed. The tone generator is responsive to the pieces of control data, which are supplied from the controller, so that the tones and/or percussion sound are produced through the tone generator. The user gives pieces of music expressing the tones and/or percussion sound through keying-in on a keyboard, which forms a part of the tone generator. Otherwise, the controller produces the pieces of control data on the basis of pieces of music data such as, for example, music data codes.

The controller is further operative to convert the identifier to the machine-recognizable image. The identifier may be stored in a non-volatile memory of the controller in the form of a binary code. Upon completion of the conversion, the controller outputs the machine-recognizable image to the outside. The machine-recognizable image may be given as a visual image or an audible sound such as, for example, a series of tones. In case where the machine-recognizable image is given as a visual image, the controller may produce the visual image on a monitor display unit or print it on a sheet of paper. On the other hand, if the machine-recognizable image is given as a series of tones, the tones are radiated from a loud speaker.

The machine-recognizable image is taken into the portable information terminal device. An image pickup device such as, for example, a CCD (Charge Coupled Device) camera or a microphone is available for the purpose. The portable information terminal device has a data processing capability and a wireless communication capability. The machine-readable image is restored to the identifier through the data processing, and the identifier is stored in a suitable memory of the portable information terminal device.

When a user wishes to control the musical instrument by means of the portable information terminal device, the user instructs the portable information terminal device to establish the wireless channel in the musical performance system. The user is assumed to produce a piece of music through the musical instrument. The user instructs the portable information terminal device to transmit an instruction, which instructs the controller to produce the piece of music through the tone generator. The portable information terminal device labels the instruction with the identifier, and transmits them to the controller through the wireless channel. When the controller receives the instruction, the controller acknowledges that the instruction is directed to the musical instrument through the analysis on the identifier. Then, the controller starts to control the tone generator as instructed by the user.

As will be appreciated from the foregoing description, the machine-recognizable image makes it possible to establish the wireless channel in the music performance system without any keying-in, and the user feels the remote control easy and speedy.

First Embodiment

Referring first to FIG. 1 of the drawings, a musical performance system embodying the present invention largely comprises a hybrid musical instrument 1 and a multi-purpose portable information terminal device 2. In this instance, the hybrid musical instrument 1 is an automatic player mute piano, and a PDA serves as the multi-purpose portable information terminal device 2. Users play tunes on the hybrid musical instrument, i.e., the automatic player mute piano 1 through acoustic piano tones. A user may prohibit the automatic player mute piano 1 from generating the acoustic piano tones during his or her performance, and hears electronic tones instead of the acoustic piano tones. When a user wishes to hear a tune without his or her fingering, he or she instructs the automatic player mute piano 1 to reenact a performance through the acoustic piano tones on the basis of a set of music data codes. The user can instruct the automatic player mute piano 1 to perform a tune through the electronic tones. Thus, the automatic player mute piano 1 behaves in various modes of operation.

The multi-purpose portable information terminal device, i.e., PDA 2 has a data processing capability together with a radio communication capability, and forms a part of a wireless LAN system 30. An access point 30*a* and other electronic devices such as, for example, personal computer systems 30*b*, 30*c* . . . are further incorporated in the wireless LAN system 30. The access point 30*a* behaves as not only a base station for the wireless communication but also a bridge for selectively interconnecting the electronic devices 30*a*, 30*b*, 30*c* . . .

A radio communication system is incorporated in the automatic player mute piano 1 and PDA 2, and a user instructs the automatic player mute piano 1 through a radio communication channel 30*d* by manipulating the PDA 2. In other words, the PDA 2 serves as a remote controller. In order to establish the radio communication channel 30*d* between the PDA 2 and the automatic player mute piano 1, the automatic player mute piano 1 is to be discriminated from the other system components 30*b*, 30*c*, . . . . In this instance, an identifier or identification code is assigned to the automatic player mute piano 1, and is stored therein. A series of characters, which expresses the identification code, is converted to a visual image 8, and the visual image 8 is output from the automatic player mute piano 1. When a user wishes to communicate with the automatic player mute piano 1 through the radio channel 30, the user reads the visual image 8 into the PDA 2, and makes the radio communication channel 30*d* established between the PDA 2 and the automatic player mute piano 1. Thus, the user pairs the PDA 2 with the automatic player mute piano 1 by using the visual image 8 expressing the identification code or discriminator. In this instance, a QR (Quick Response) code (trademark) is used as the identifier.

Automatic Player Mute Piano

The automatic player mute piano 1 is the combination between an electronic system 1*a* and an acoustic piano 1*b*. In this instance, a grand piano is employed as the acoustic piano 1*b*. The electronic system 1*a* is installed in the acoustic piano 1*b*, and accomplishes tasks such as the automatic playing, performance through the electronic tones, mute performance and radio communication with the PDA 2.

The grand piano 1*b* includes a keyboard 1*c* or an array of black and white keys 1*d*, action units 1*e*, hammers 1*f*, strings 1*g* and a piano cabinet 1*h*. The keyboard 1*c* is mounted on a key bed of the piano cabinet 1*h*, and the action units 1*e*, hammers 1*f* and strings 1*g* are accommodated in the piano cabinet 1*h*. The pitch names are respectively assigned to the black and white keys 1*d*, and a user designates the tones by depressing the black and white keys 1*d*. The strings 1*g* are designed to generate tones at the pitch names through vibrations thereof.

The black and white keys 1*d* are respectively connected to the action units 1*e*, and depressed keys 1*d* actuate the associated action units 1*e*. The hammers 1*f* are driven for rotation toward the strings 1g by the actuated action units 1e, and are brought into collision with the associated strings 1g at the end of the rotation. Then, the strings 1g vibrate so as to generate the tones at the designated pitch names.

The electronic system 1a includes a controller 1j, an array of solenoid-operated key actuators 1k, key sensors 1m and a hammer stopper 1n. The controller 1j is hung from the key bed, and is electrically connected to the solenoid-operated key actuators 1k, key sensors 1m and an electric motor of the hammer stopper 1n. The controller 1j has a radio communication capability and data processing capability, and selectively drives the solenoid-operated key actuators 1k and electric motor of the hammer stopper 1n.

The array of solenoid-operated key actuators 1k are hung from the key bed, and the solenoid-operated key actuators 1k penetrate the key bed for selectively pushing the rear portions of the black and white keys 1d with the plungers. As a result, the black and white keys 1d pitch up and down without any fingering of a human player. The controller 1j analyzes pieces of music information such as MIDI (Musical Instrument Digital Interface) messages, and selectively energizes the solenoid-operated key actuators 1k. The solenoid-operated key actuators 1k thus energized by the controller 1j give rise to the key motion of the associated black and white keys 1d, and cause the associated hammers 1f to be driven for the rotation toward the associated strings 1g.

The array of key sensors 1m is provided under the front portions of the black and white keys 1d, and the key sensors 1m monitor the associated black and white keys 1d. When a user wishes to record his or her performance, the controller 1j starts to analyze the movements of black and white keys 1d. While the user is fingering on the keyboard 1c, the key sensors 1m reports the movements of black and white keys 1d to the controller 1j, and the controller 1j produces music data codes representative of the key movements. When the user completes the performance, a set of music data codes is left in the controller 1j, and the controller 1j stores the set of music data codes expressing the performance in a suitable memory.

If, on the other hand, the user wishes to perform a tune without the acoustic piano tones, the controller 1j rotates the hammer stopper 1n such that the hammer stopper 1n is moved onto the trajectories of the hammers 1f. While the user is fingering the tune on the keyboard 1c, the hammers 1f rebound on the hammer stopper 1n before striking the strings 1g, and prohibits the strings 1g from the vibrations. Thus, any acoustic piano tone is not generated in the acoustic piano 1b. Nevertheless, the controller 1j analyzes the key movements, and produces the music data codes for electronically generating the electronic tones.

As described hereinbefore, the controller 1j cooperates with the solenoid-operated key actuators 1k, key sensors 1m and hammer stopper 1n for the automatic playing, mute performance and electronic performance. Although users give their instructions to the controller 1j through a manipulating panel 13 provided on the front panel of the controller 1j, they can communicate with the controller 1j by using the PDA 2. An input-and-output center 3 is provided on a suitable panel of the controller 1j, and an extension slot, an USB (Universal Serial Bus) interface terminal 5a and video-output terminal 5b are incorporated in the input-and-output center 3. An extension card such as a wireless LAN card 4 is inserted into the extension slot, and the wireless LAN card 4 makes it possible to communicate with the PDA 2. A printer 7 is connected to the USB interface 5a, and a monitor display 6 is connected to the video-output terminal 5b.

A discriminator is stored in the controller 1j, and makes the automatic player piano 1 discriminative from the other LAN component devices such as the personal computer systems 30b and 30c. In this instance, an ESSID code or a WEP (Wired Equivalent Privacy) key is provided as the discriminator. The discriminator is expressed by a series of characters. However, the series of characters is causative of troubles due to a misreading. In order easily to transfer the discriminator from the controller 1j to the PDA 2, the controller 1j converts the series of characters to the visual image 8, i.e., two-dimensional QR code, which the PDA 2 correctly to recognize, and outputs the visual images through the monitor display 6 or printer 7.

Figure 2:
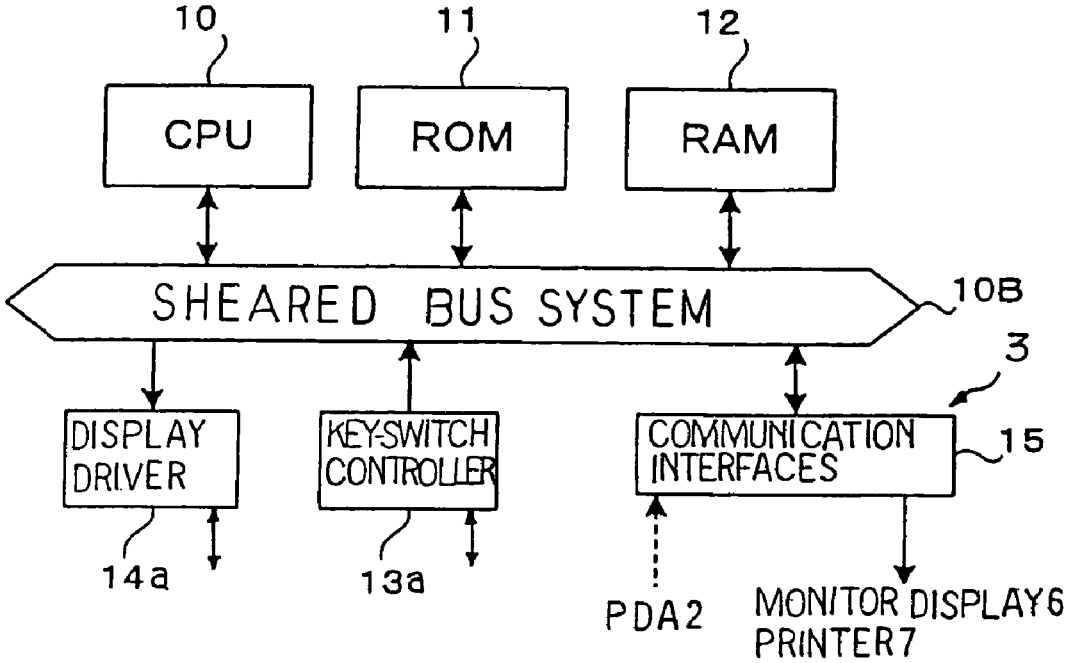
FIG. 2 is a block diagram showing the system configuration of an electronic system incorporated in an automatic player mute piano of the musical performance system.

FIG. 2 shows an electronic system in the controller 1j. The electronic system includes a central processing unit 10, which is abbreviated as CPU, a read only memory 11, which is abbreviated as ROM, a read only memory 12, which is abbreviated as RAM, a key-switch controller 13a for the manipulating panel 13, a display driver 14a for a display window 14, communication interfaces 15 and a shared bus system 10B. The central processing unit 10 and other system components 11, 12, 13a, 14a and 15 are connected to the shared bus system 10B, and address codes, control codes, instruction codes, data codes are transferred between the central processing unit 10 and the other system components 11, 12, 13a, 14a and 15 through the shared bus system 10B. Though not shown in FIG. 2, an external memory device such as, for example, a hard disk driver or floppy disk driver may be further connected to the communication interfaces 15.

The central processing unit 10 is the origin of the data processing capability, and accomplishes tasks through execution of programmed instruction codes. The instruction codes form a computer program, and are stored in the read only memory 11 together with the identification code and other data codes. In this instance, the read only memory 11 is implemented by semiconductor flash read only memory devices. For this reason, the computer program, data codes and identification code are electrically erasable and electrically rewriteable in the read only memory 11.

The computer program is broken down into a main routine program and several subroutine programs. When a user powers the controller 1j, the central processing unit 10 initializes the electronic system, and starts to reiterate the main routine program. While the central processing unit 10 reiterates the main routine program, users can give his or her instructions to the central processing unit 10 through the manipulating panel 13 or PDA 2. With user's instruction, the central processing unit 10 determines the task to be accomplished, and the main routine program starts to branch appropriate subroutine program or programs. The subroutine programs will be hereinlater described in detail. The random access memory 12 offers a working area to the central processing unit 10, and temporarily stores data codes, control codes and so forth. The central processing unit 10 accomplishes a file management for the random access memory 12 through the computer program.

The key-switch controller 13a is connected to the manipulating panel 13, and periodically checks the manipulating panel 13 to see whether or not the keys, switches and/or control levers are moved by a user. When the key-switch controller 13a finds a key, a switch or control lever to be moved, the key-switch controller 13a specifies the key, switch or control lever, and informs the central processing unit 10 of the key, switch or control lever through the shared bus system 10B.

The display driver 14a is connected to the display window 14, and image data codes, which are representative of images to be produced, are transferred from the central processing unit 10 to the display driver 14a. When the display driver 14a receives the image data codes, the display driver 14a supplies visual image signals to the display window 14 so as to the produce the visual images expressing prompt messages, status messages and visual image 8 on the display window 14.

The communication interfaces 15 have data buffer circuits, and are connected to the terminals in the card slot, where the wireless LAN card is inserted, USB interface terminal 5*a* and the video-out terminal 5*b*. Thus, the central processing unit 10 communicates with the PDA 2, monitor display 6 and printer 7 through the communication interfaces 15.

PDA

Turning back to FIG. 1, the PDA 2 includes an electronic system, a touch-panel liquid crystal display device 2*a*, manipulating switches 2*b* and an image pickup device 26 such as, for example, a CCD (Charge Coupled Device) camera, and is formed with an extension slot. A wireless LAN card 9 is inserted into the extension slot.

The wireless LAN cards 4 and 9 transmit and receive electromagnetic waves, and permit the electronic system of the PDA 2 to communicate with the electronic system of the controller 1*j* through the wireless channel 30*d*. Although the PDA 2 is communicable with the personal computer systems 30*b* and 30*c* through access point 30*a*, the identification code makes the controller 1*j* distinguishable from the computer systems 30*b* and 30*c*, and, for this reason, users can control the automatic player mute piano 1 by means of the PDA 2.

Various images are taken into the PDA 1 through the image-pickup device 26. When a user directs the image-pickup device 26 to the QR code 8, the visual image of QR code is taken into the PDA 2, and is produced on the touch-panel liquid crystal display device 2*a*. The image of QR code 8 is transferred from the monitor display unit 6 or a sheet of paper to the PDA2 through the image pick-up device 26, and the QR code 8 is decoded to the identification code. Using the identification code, the user makes the PDA 2 paired with the controller 1*j*.

Figure 3:
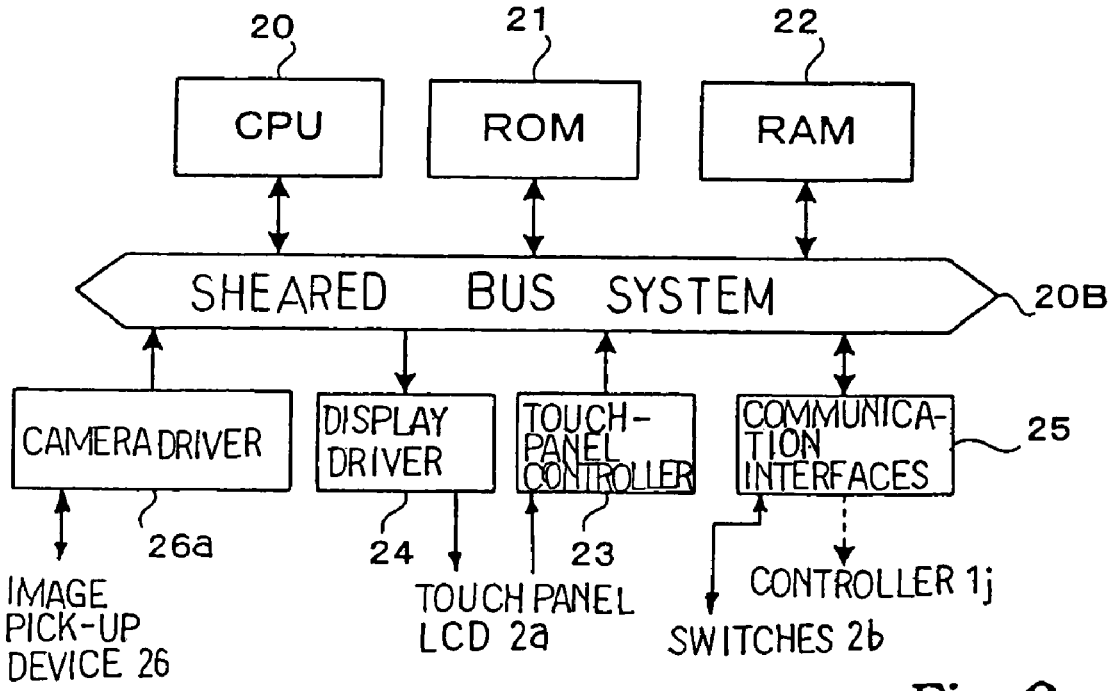
FIG. 3 is a block diagram showing the system configuration of an electronic system incorporated in a PDA forming another part of the musical performance system.

FIG. 3 shows the electronic system in the PDA 2. The electronic system includes a central processing unit 20, which is abbreviated as CPU, a read only memory 21, which is abbreviated as ROM, a read only memory 22, which is abbreviated as RAM, a touch-panel controller 23, a display driver 24, communication interfaces 25, a CCD camera driver 26*a* and a shared bus system 20B. Although an electronic tone generator and a sound system are further incorporated in the electronic system, these system components are not illustrated in FIG. 3, because the electronic tone generator and sound system are well known to persons ordinarily skilled in the art. The central processing unit 20 and other system components 21, 22, 23, 24, 25 and 26*a* are connected to the shared bus system 20B, and address codes, control codes, instruction codes, data codes are transferred between the central processing unit 20 and the other system components 21, 22, 23, 24, 26 and 26*a* through the shared bus system 20B.

The central processing unit 20 is the origin of the data processing capability, and accomplishes tasks through execution of programmed instruction codes. The instruction codes form a computer program, and are stored in the read only memory 21 together with the identification code and other data codes. In this instance, the read only memory 21 is implemented by semiconductor flash read only memory devices. For this reason, the computer program, data codes and identification code are electrically erasable and electrically rewriteable in the read only memory 21.

The computer program is broken down into a main routine program and several subroutine programs. When a user powers the PDA 2, the central processing unit 20 initializes the electronic system, and starts to reiterate the main routine program. The central processing unit 20 produces visual images expressing tasks to be given by users on the touch-panel liquid crystal display device 2*a*. While the central processing unit 20 reiterates the main routine program, users can give his or her instructions to the central processing unit 20 by pushing a visual image expressing a task to be accomplished. With user's instruction, the central processing unit 10 determines the task to be accomplished, and the main routine program starts to branch appropriate subroutine program or programs. The subroutine programs will be hereinlater described in detail. The random access memory 22 offers a working area to the central processing unit 20, and temporarily stores data codes, control codes, identification code and so forth. The central processing unit 20 manages the files in the random access memory 22 through the execution of computer program.

The touch-panel controller 23 cooperates with the display driver 24. When the central processing unit 20 supplies pieces of image data to the display driver 24, the display driver 24 produces an image signal from the pieces of image data, and sweeps the liquid crystal display with the image signal so as to produce the visual images. When the task menu is produced on the liquid crystal display device, the user selectively pushes the visual image of a task with a pen or a finger. Then, the touch-panel controller determines the coordinate of the pushed area, and reports it to the central processing unit 20 so that the central processing unit 20 determines the task. Thus, the display driver 24 and touch-panel controller 23 permits the users to communicate with the central processing unit 20 through the touch-panel liquid crystal display device 2*a*. When the visual image of QR code is taken into the PDA 2, the central processing unit 10 requests the display driver 24 to produce the visual image of QR code on the liquid crystal display device 2*a*, and permits the user to confirm the QR code.

The communication interfaces 25 are connected to the wireless LAN card 9 and switches 2*b*, and the CCD camera driver 26*a* is connected to the image pickup device 26. When a user manipulates on the array of switches 2*b*, the manipulated switch is reported from the associated communication interface 25 to the central processing unit 20. The wireless LAN card 9 has the role same as that of the wireless LAN card 4.

In this instance, the QR code 8 is taken into the PDA 2 through the image pickup device 26. When a user wishes to take the QR code into the PDA 2, the user directs the image pickup device 26 to the visual image of QR code 8. The controller 1*j* has already produced the visual image of QR code 8 on the monitor display unit 6, or has already printed the visual image of QR code 8 on a sheet of paper. The user instructs the central processing unit 20 to take the visual image of QR code 8, the central processing unit 20 requests the CCD camera driver 26*a* to supply a driving pulse signal to the image pickup device 26, and the visual image of QR code 8 is transferred from the image pickup device 26 to the central processing unit 20. The central processing unit 20 temporarily stores the pieces of image data in the random access memory 22, and restores the QR code from the pieces of image data. Thus, the QR code is smoothly transferred from the controller 1*j* to the PDA 2 without any keying-in work.

Subroutine Programs

Figure 4:
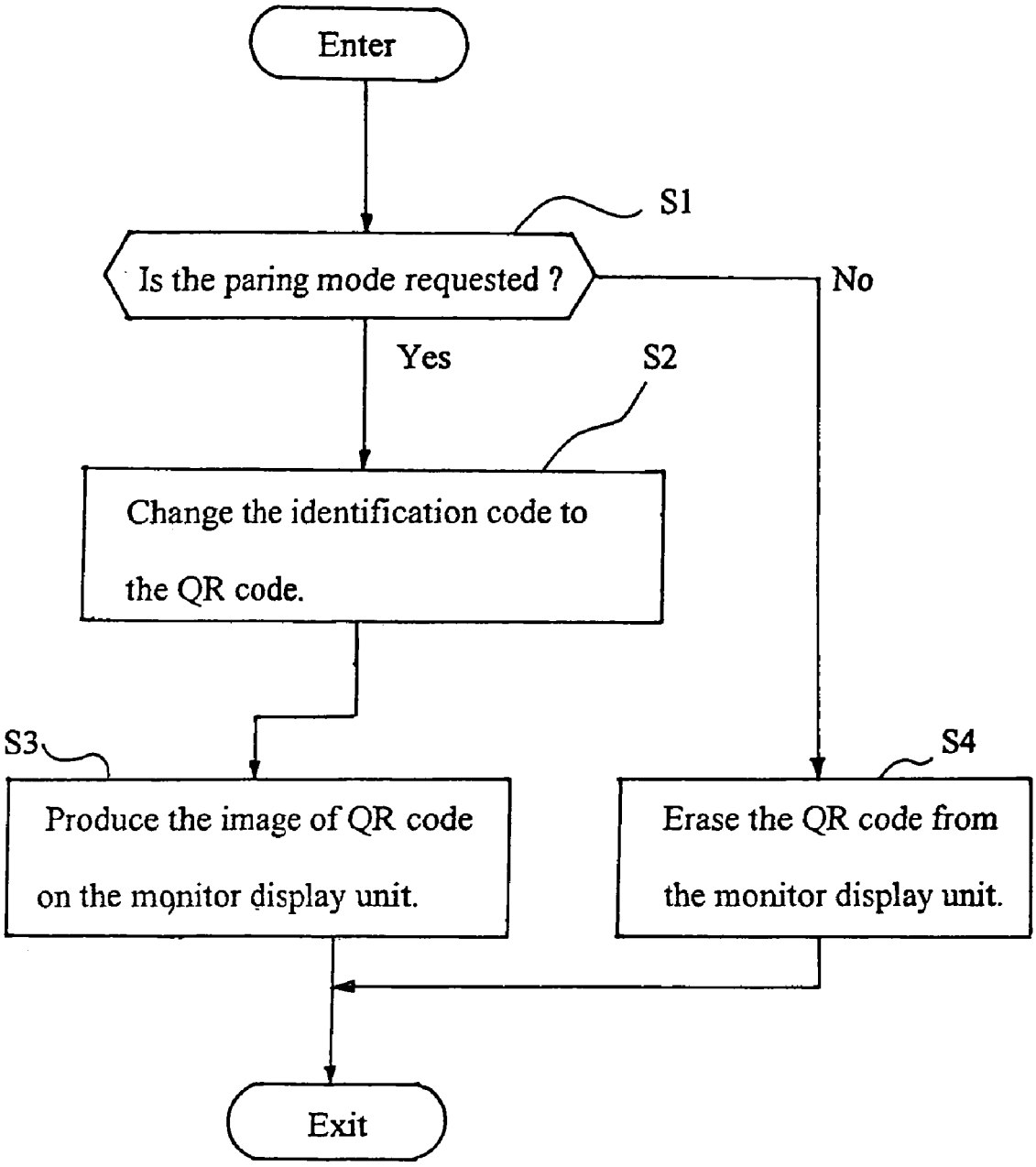
FIG. 4 is a flowchart showing a job sequence for a paring work.

Description is hereinafter made on the subroutine programs, which run on the central processing units 10 and 20, for the wireless communication between the controller 1*j* and the PDA 2. FIG. 4 shows the subroutine program for producing the image of QR code 8 on the monitor display 6 or a sheet of paper. A user is assumed to wish to use the PDA 2 as a remote controller. Both of the automatic player mute piano 1 and PDA 2 are established in the pairing mode.

In detail, the user instructs the controller 1*j* to produce the visual image of QR code 8 on the monitor display 6 or a sheet of paper. Then, the main routine program starts to branch to the subroutine program shown in FIG. 4 at regular time intervals. The central processing unit 10 firstly checks the random access memory 12 to see whether or not a flag is indicative of that the user has instructed the controller 1*j* to produce the image of QR code 8 as by step S1.

Since the flag rose at the acknowledgement of the user's instruction, the answer at step S1 is given affirmative, and the central processing unit 10 changes the identification code such as the ESSID to a QR code as by step S2. The central processing unit 10 supplies the image data codes expressing the image of QR code 8 to the communication interface 15 connected to the monitor display unit 6 or printer 7, and a display driver or printer driver, which is built in the monitor display unit 6 or printer 7, produces the image of QR code 8 on the monitor display 6 as by step S3 or prints it on a sheet of paper.

When the user instructs the controller 1*j* to erase the image of QR code 8, the central processing unit 10 pulls down the flag in the main routine program. For this reason, the answer at step S1 is changed to negative after the next timer interruption, and the central processing unit 10 instructs the display driver of the monitor display unit 6 to erase the image of QR code 8 through the communication interface 15 as by step S4. For this reason, the display driver changes the picture on the monitor display unit 6 to a menu. Thus, while the user's instruction is being effective, the central processing unit 10 periodically enters the subroutine program shown in FIG. 4, and produces the image of QR code 8 on the monitor display unit 6 or a sheet of paper.

Figure 5:
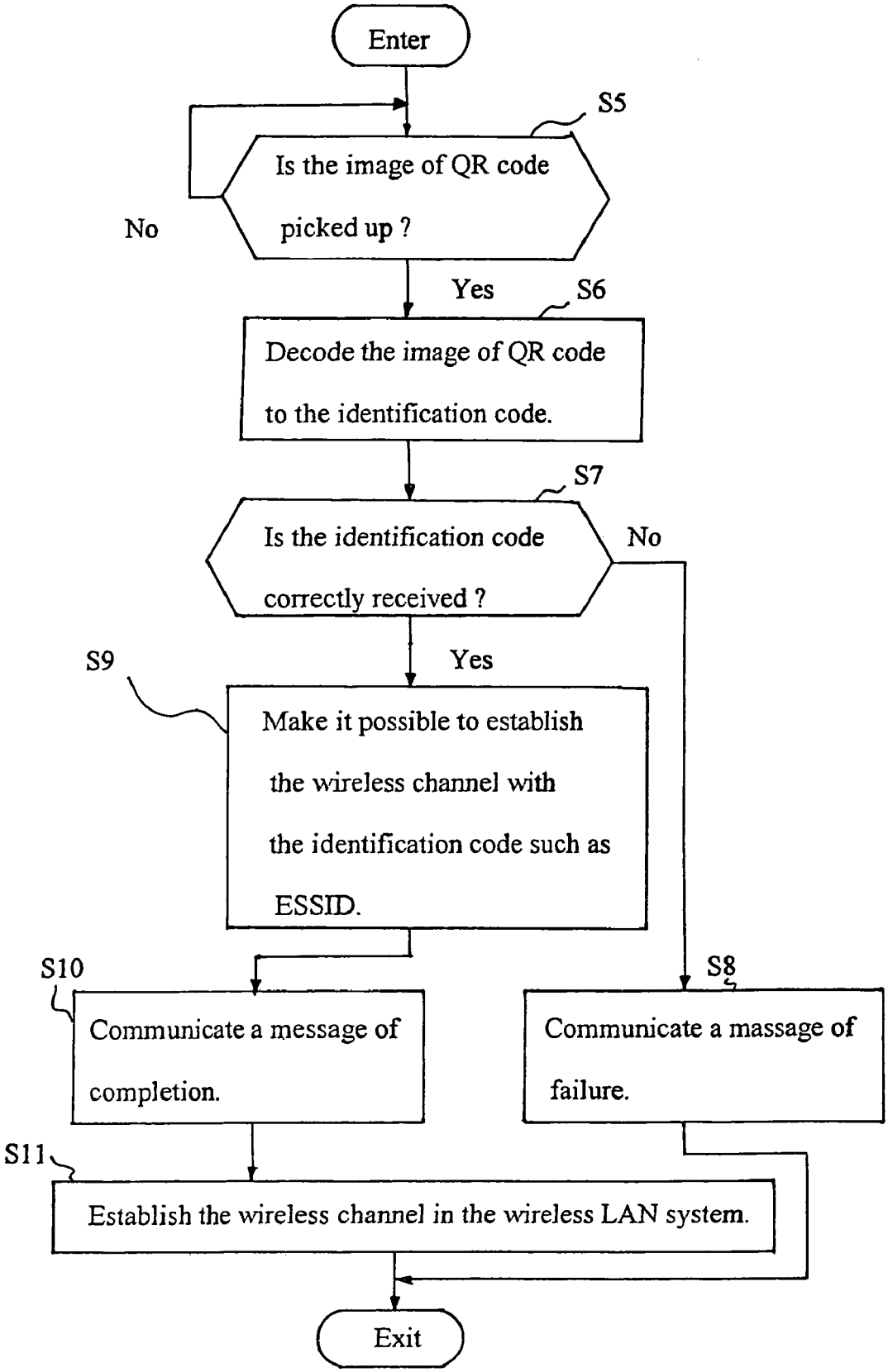
FIG. 5 is a flowchart showing a job sequence for an image acquisition.

FIG. 5 shows the subroutine program for registration of the identification code in the PDA 2. When the user requests the PDA 2 to start the pairing work, the central processing unit 20 requests the CCD camera driver 26*a* to transfer the picture from the image pickup device 26. The CCD camera driver 26*a* periodically transfers the picture on the image area of the image pickup device 26 from the image pickup device 26 through an image-carrying signal to the central processing unit 20. The central processing unit 20 checks the picture to see whether or not the image of QR code 8 is found in the picture as by step S5. If any image of QR code 8 is not found in the picture, the answer at step S5 is given negative "No", and the central processing unit 20 repeats the job at step S5 on every picture received from the image pickup device 26. While the answer at step S5 is being given negative, the central processing unit 20 may produce a prompt message on the touch-panel liquid crystal display device 2*a*. Otherwise, the central processing unit 20 may alarm the user to the absence of the QR code through a suitable sound.

When the user directs the image pickup device 26 to the visual image of QR code 8, the visual image of QR code 8 is fallen onto the image area of the image pickup device 26, and the CCD camera driver 26*a* transfers the visual image of QR code 8 through the image-carrying signal to the central processing unit 20. Then, the central processing unit 20 finds the image of QR code 8, and the answer at step S5 is changed to affirmative "Yes". The central processing unit 20 decodes the QR code to the identification code such as ESSID, or WEP key as by step S6. Thus, the PDA 2 easily obtains the string of characters, i.e., identification code without any keying-in work.

Subsequently, the central processing unit 20 confirms whether or not the identification code is correctly transferred through the visual image of QR code 8 as by step S7. The confirmation may be carried out as follows. The central processing unit 20 requests the controller 1*j* to communicate through the wireless channel 30*d* on the assumption that the identification code already received correctly stands for the automatic player mute piano 1.

If the identification code in the answer is different from the identification code decoded from the image of QR code 8, the answer is given negative "No", and the central processing unit 20 produces a massage of failure on the touch-panel liquid crystal display device 2*a* as by step S8. With the failure message, the user instructs the PDA 2 to take the visual image of QR code 8 thereinto by means of the image pickup device 26. Otherwise, the user instructs the controller 1*j* to produce the visual image of QR code 8 on the monitor display unit 6 or a sheet of paper, again, and instructs the PDA 2 to take the visual image of QR code 8 by means of the image pickup device 26.

When the automatic player mute piano 1 transmits the answer with the identification code same as that already received to the PDA 2, the answer at step S7 is given affirmative "Yes", and the central processing unit 20 makes it possible to establish the wireless channel between the wireless LAN cards 4 and 8 by registering the identification code as by step S9. Upon completion of the registration, the central processing unit 20 produces a message of completion on the touch-panel liquid crystal display unit 2*a* as by step S10.

The PDA2 establishes the wireless channel 30*d* in the LAN system, again, and restarts to communicate with the automatic player mute piano 1. The central processing unit 20 may check the memories 21 and 22 to see whether or not a computer program for controlling the automatic player mute piano 1 has been already loaded and/or whether or not the computer program is available for the automatic player mute piano 1. If the controller 1*j* confirms that the PDA 2 can control the automatic player mute piano 1, the central processing unit 20 exits the subroutine program. On the other hand, if the suitable computer program is not loaded in the PDA 2, the central processing unit 20 downloads the suitable computer program through the wireless channel 30*d* so that the PDA 2 gets ready to control the automatic player mute piano 1. Upon completion of the down-loading, the central processing unit 20 exits the subroutine program.

As will be understood from the foregoing description, the identification code is transferred from the automatic player mute piano 1 to the PDA 2 through the visual image, and makes it possible to establish the wireless channel 30*d* between the wireless LAN cards 4 and 9 without any keying-in work on the identification code.

Figure 6:
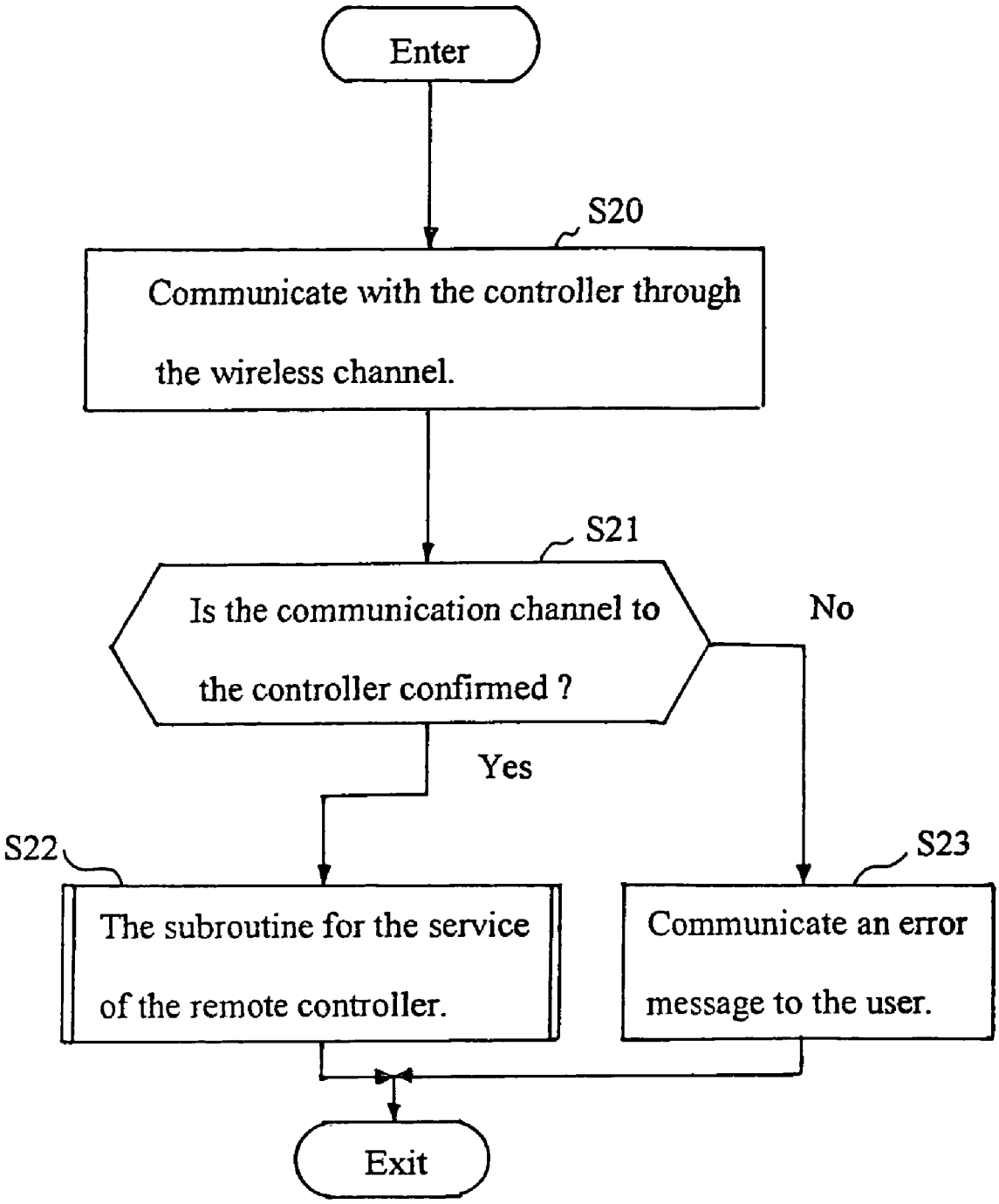
FIG. 6 is a flowchart showing a job sequence for establishing a wireless channel.
Figure 7:
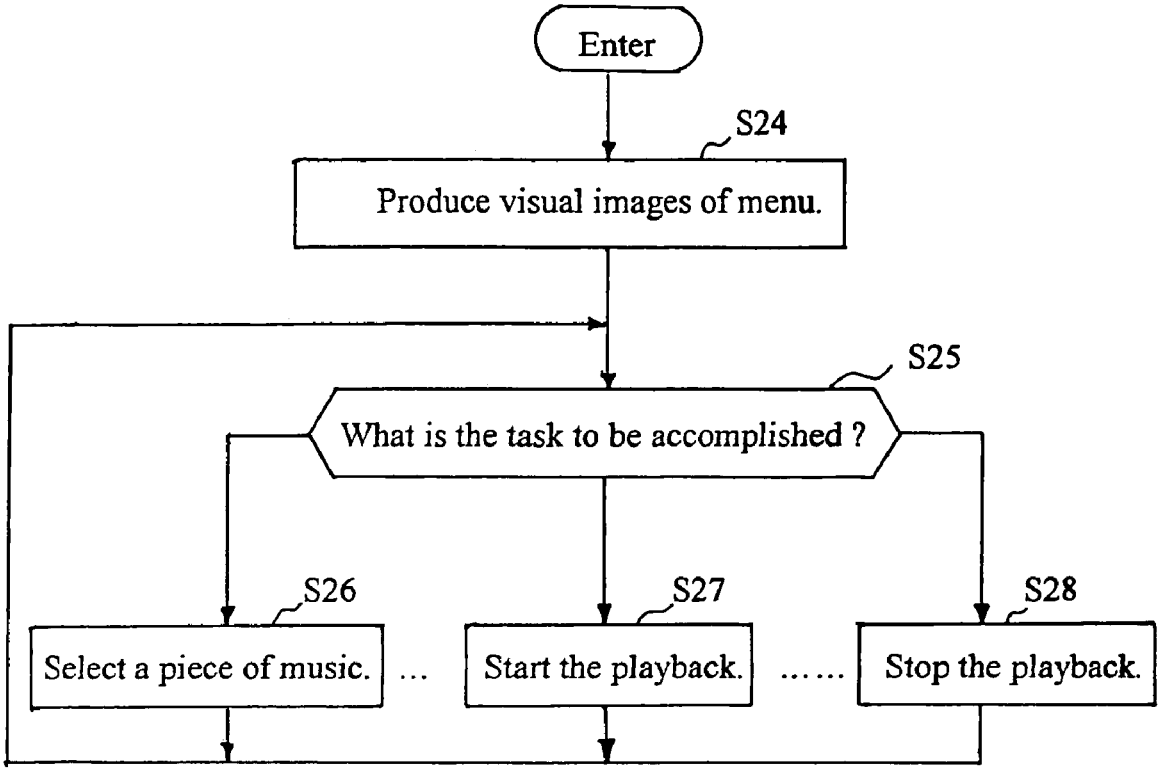
FIG. 7 is a flowchart showing a job sequence for making the PDA serves as a remote controller.

Subsequently, description is made on the control on the automatic player mute piano 1. FIGS. 6 and 7 show job sequences for the control on the automatic player mute piano 1. A user is assumed to wish to control the automatic player mute piano 1 by means of the PDA 2.

The central processing unit 20 firstly calls the central processing unit 10 by sending the identification code through the wireless channel 30*d* as by step S20, and waits for the answer from the central processing unit 10. The central processing unit 20 periodically checks the communication interface 25 to see whether or not the wireless channel 30*d* is properly established between the PDA 2 and the automatic player mute piano 1 as by step S21.

When the answerback, which contains the identification code, reaches the communication interface 25, the central processing unit 20 confirms that the wireless channel 30*d* has been already established between the PDA 2 and the automatic player mute piano 1, and the answer at step S21 is given affirmative "Yes". With the positive answer "Yes", the central processing unit 20 proceeds to the subroutine program S22. On the other hand, if the proper answerback does not reach the communication interface 25 for a certain time period, the answer at step S21 is given negative "No". Then, the central processing unit 20 produces an error message on the touch-panel liquid crystal display unit 2*a* as by step S23.

The central processing unit 20 is assumed to proceed to the subroutine program S22 with the positive answer "Yes". The central processing unit 20 firstly produces visual images of menu on the touch-panel liquid crystal display device 2*a* as by step S24, and waits for a piece of coordinate data, which will be supplied from the touch-panel controller 23.

When the piece of coordinate data reaches the touch-panel controller 23, the central processing unit 20 fetches the piece of coordinate data from the touch-panel controller 23. The central processing unit 20 examines the piece of coordinate data to see what is the task to be accomplished as by step S25. As described hereinbefore in conjunction with the automatic player mute piano 1, the automatic player mute piano 1 has the various modes of operation, and the visual images in menu selectively lead the automatic player mute piano 1 to the mode of operation.

The user is assumed to push a visual image expressing a tune. Then, the touch panel controller 23 informs the central processing unit 20 of the coordinate assigned to the area pushed by the user, and the central processing unit 20 determines the tune on the basis of the coordinate. The central processing unit 20 proceeds to step S26, and transfers the piece of control data expressing the tune to the wireless LAN card 9. The piece of control data is transmitted from the wireless LAN card 9 through the wireless channel 30*d* to the wireless LAN card 4, and is relayed from the wireless LAN card 4 to the central processing unit 10.

If the user pushes a visual image expressing the initiation of playback, the central processing unit 20 determines user's instruction, and transmits the piece of control data expressing the initiation of playback to the controller 1*j* as by step S27. When the user wishes to stop the playback, he or she pushes the visual image expressing the interruption of the playback, and the central processing unit 20 transmits the piece of control data through the wireless channel 30*d* to the controller 1*j* as by step S28.

Thus, the PDA 2 serves as a remote controller. Since the user can easily pair the automatic player mute piano 1 with the PDA 2 through the visual image of QR code 8, the user does not feel the pairing work troublesome.

Second Embodiment

Figure 8:
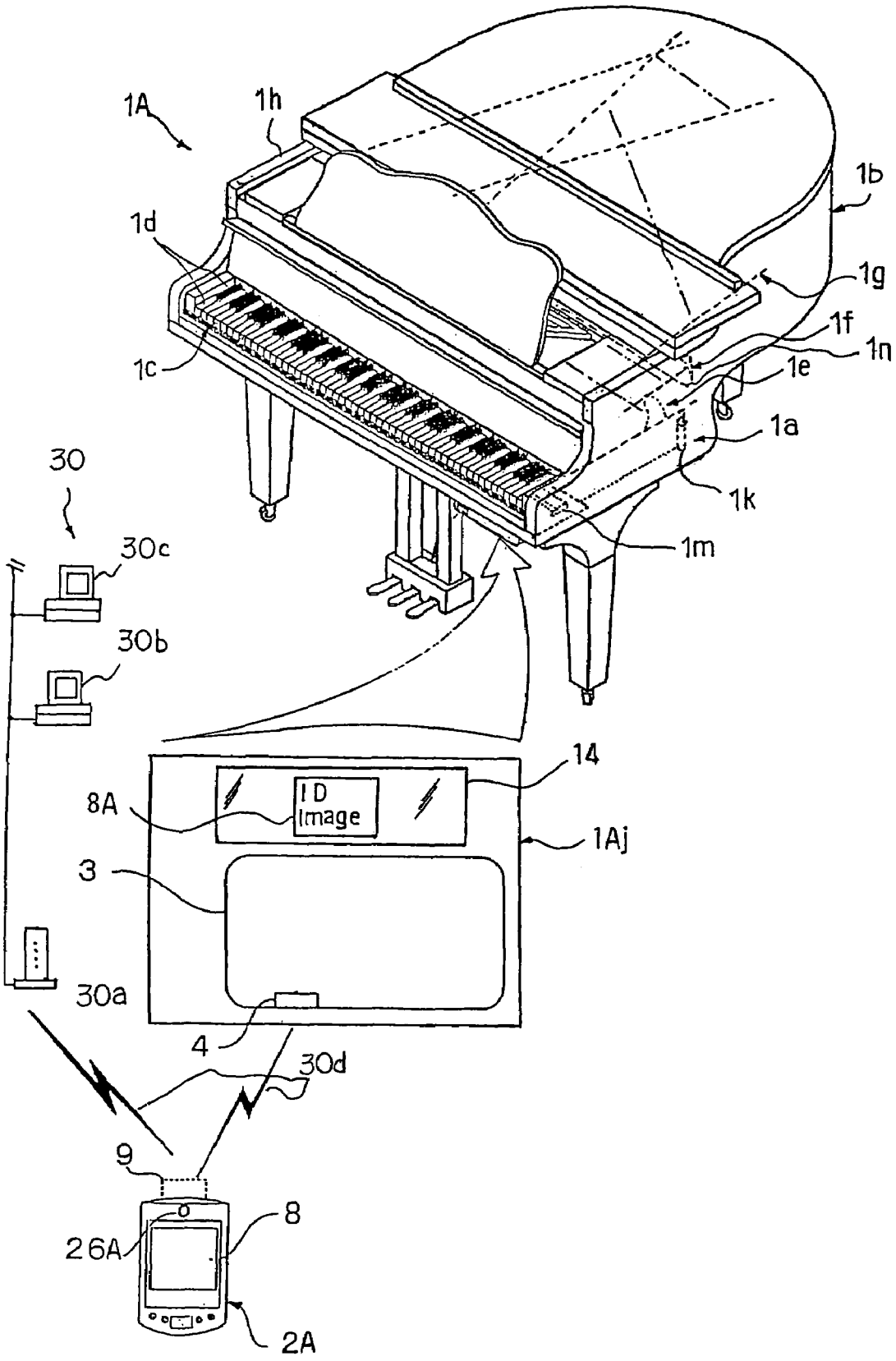
FIG. 8 is a schematic view showing another music performance system of the present invention.

Turning to FIG. 8 of the drawings, another musical performance system embodying the present invention largely comprises an automatic player mute piano 1A and a PDA 2A. The automatic player mute piano 1A is similar to the automatic player mute piano 1 except for a controller 1Aj. For this reason, the other component parts of the automatic player mute piano 1A are labeled with the references designating the corresponding component parts of the automatic player mute piano 1.

The interface terminal 5*a* and video-output terminal 5*b* are not provided on the panel. Even if the terminals 5*a* and 5*b* are incorporated in the controller 1Aj, the terminals 5*a* and 5*b* are not any obstacle. The terminals 5*a* and 5*b* are merely redundant.

The PDA 2A is different from the PDA 2 in that a high-resolution CCD camera is employed as an image pickup device 26A. For this reason, the PDA 2A discriminates a small visual image of QR code 8A from the visual images of other QR codes.

A computer program runs on the central processing unit 10 of the controller 1Aj, and is similar to the computer program of the first embodiment except that the central processing unit 10 transfers the pieces of image data to the display driver 14*a* instead of the communication interface 15. For this reason, the visual image of QR code 8A is produced in the display window 14 as shown in the figure.

In the pairing mode, a user directs the high-resolution CCD camera 26A to the display window 14, and takes the visual image of QR code 8A into the PDA 2A through the high-resolution CCD camera 26A. The computer program, which runs on the central processing unit 20, is similar to that of the first embodiment, and no further description is hereinafter incorporated for the sake of simplicity.

All the advantages of the first embodiment are achieved by the musical performance system implementing the second embodiment. Although at least one of the monitor display unit 6 and printer 7 is required for the first embodiment, those external devices are not required for the musical performance system of the second embodiment.

Third Embodiment

Figure 9:
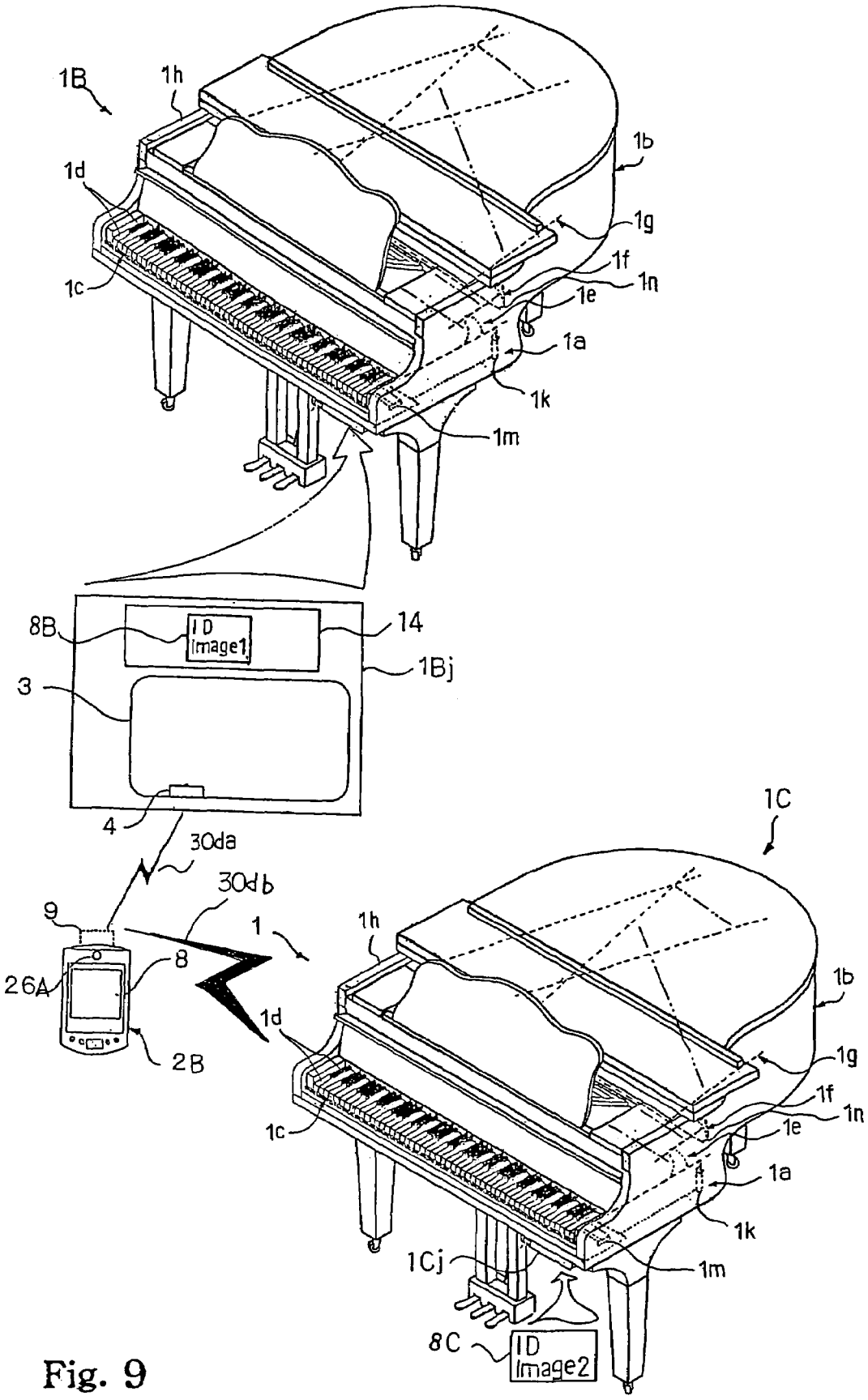
FIG. 9 is a schematic view showing yet another music performance system of the present invention.

FIG. 9 shows yet another music performance system embodying the present invention. The music performance system implementing the third embodiment includes plural musical instruments 1B and 1C and a PDA 2B shared between the plural musical instruments 1B and 1C. In this instance, the automatic player mute pianos 2B and 2C form parts of the musical performance system. For this reason, component parts of each automatic player mute piano 2B/2C are labeled with the references designating the corresponding component parts of the automatic player mute piano 1 without detailed description.

The computer program, which is same as the computer program installed in the controller 1Aj, runs on the central processing unit 10 of each controller 1Bj/1Cj, and identification codes, which are different from each other, are stored in the memories of the controllers 1Bj and 1Cj, respectively.

The PDA 2B is similar to the PDA 2A, and component parts of the PDA 2B are labeled with references designating the corresponding parts of the PDA 2A. The computer program, which is similar to the computer program installed in the controller 1Aj except for the jobs to make the PDA 2A selectively paired with the automatic player mute pianos 1B and 1C, runs on the central processing unit 20 of the PDA 2B so that the PDA 2B serves as a remote controller communicable with the automatic player mute pianos 1B and 1C.

In order to make it possible selectively to communicate with the automatic player mute pianos 1B and 1C, the identification codes are independently transferred from the controllers 1Bj and 1Cj to the PDA 2B. The transferring work is same as that of the second embodiment. The user requests the controllers 1Bj/1Cj to produce visual images of QR codes on the display windows 14. Then, the central processing units 10 converts the identification codes to QR codes, respectively, and request the display drivers 14*a* to produce the visual images of QR codes 8B and 8C on the display windows 14.

The PDA 2B repeats the pairing work on the automatic player mute pianos 1B and 1C so that the user takes the visual images 8*b* and 8*c* into the PDA 2B through the high-resolution CCD camera 26A.

When a user wishes to communicate with the automatic player mute piano 1B, the user establishes the wireless channel 30*da* between the PDA 2B and the automatic player mute piano 1B with the identification code assigned thereto, and controls the automatic player mute piano 1B through the PDA 2B. On the other hand, when the user wishes to communicate with the other automatic player mute piano 1C, the user establishes the wireless channel 30*db* between the PDA 2B and the automatic player mute piano 1C with the identification code assigned thereto, and controls the automatic player mute piano 1C through the PDA 2B.

Thus, all the advantages of the first embodiment are also achieved by the musical performance system implementing the third embodiment. Moreover, users can control more than one musical instrument through only one portable information terminal device 2B.

Although particular embodiments of the present invention have been shown and described, it will be apparent to those skilled in the art that various changes and modifications may be made without departing from the spirit and scope of the present invention.

For example, the automatic player mute piano 1 does not set any limit to the technical scope of the present invention. Users may communicate with other hybrid musical instrument such as, for example, a mute piano, an automatic player piano and other sorts of automatic player musical instrument and an electronic musical instrument such as, for example, an electronic keyboard and an electronic percussion instrument by using the PDA or another portable information terminal device.

Another musical performance system of the present invention may have a tablet instead of the PDA 2. Any sort of portable information terminal device is available for the musical performance system of the present invention in so far as it has the data processing capability and communication capability as well as a proper man-machine interface. Several models of mobile telephones may serve as the potable information terminal device for the musical performance system according to the present invention. A personal computer is also available for the wireless communication to the controller of a musical instrument.

The wireless LAN does not set any limit to the technical scope of the present invention. For example, a controller of a musical instrument may be connected to a mobile telephone through a mobile telephone network. In this instance, a telephone number, which is different from the mobile telephone, has been already assigned to the controller. Otherwise, a musical performance system of the present invention may be built on the basis of another sort of private wireless communication technique.

An ESSID and a WEP code do not set any limit to the technical scope of the present invention. Any sort of identification code is available for the musical performance system in so far as the identification code is encoded to a visual image.

The QR code does not set any limit to the technical scope of the present invention. Another sort of visual codes such as, for example, bar codes may be corresponding to the identification codes. Any visual images are available for the code transmission in so far as the visual images are uniquely correlated with the identification codes.

The identification code may be converted to a depressed key pattern. In detail, a set of identification codes has been correlated with plural patterns of depressed keys. When a user instructs the controller 1*j* to lay the black and white keys 1*d* on one of the plural patterns, the controller 1*j* selectively drives the solenoid-operated key actuators 1*k*, and makes selected ones of the black and white keys 1*d* sunk. As a result, the black and white keys 1*d* are laid on the selected pattern. The user takes the pattern into the PDA2 through the image pickup device 26, and the central processing unit 20 determines the identification code on the basis of the image of the pattern.

The subroutine program for the communication with the automatic player mute piano may be installed in the PDA before delivery to the users.

The image pickup device 26 may be implemented by a scanner.

Figure 10:
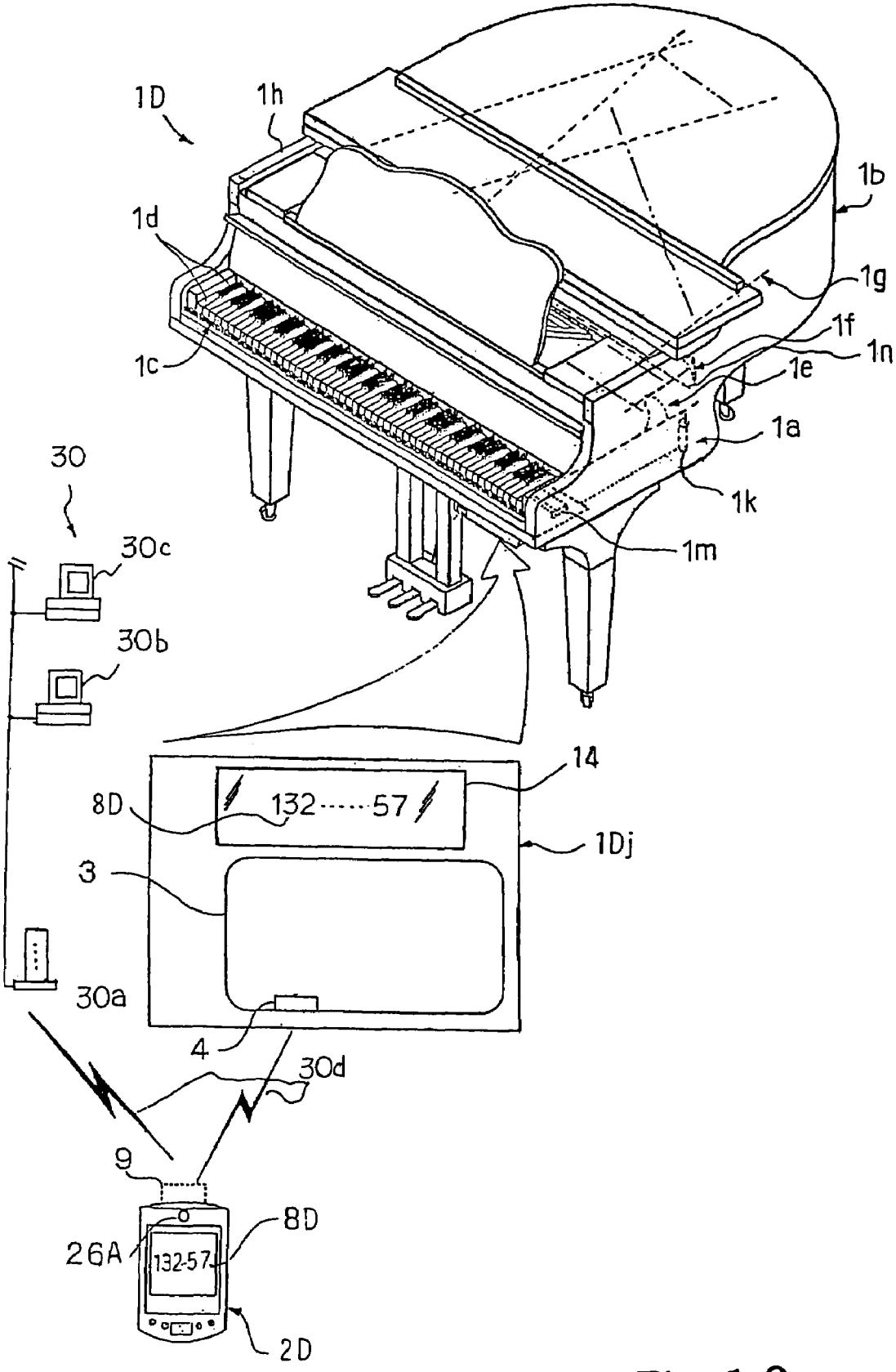
FIG. 10 is a schematic view showing a modification of the musical performance system shown in FIG. 8.
Figure 11:
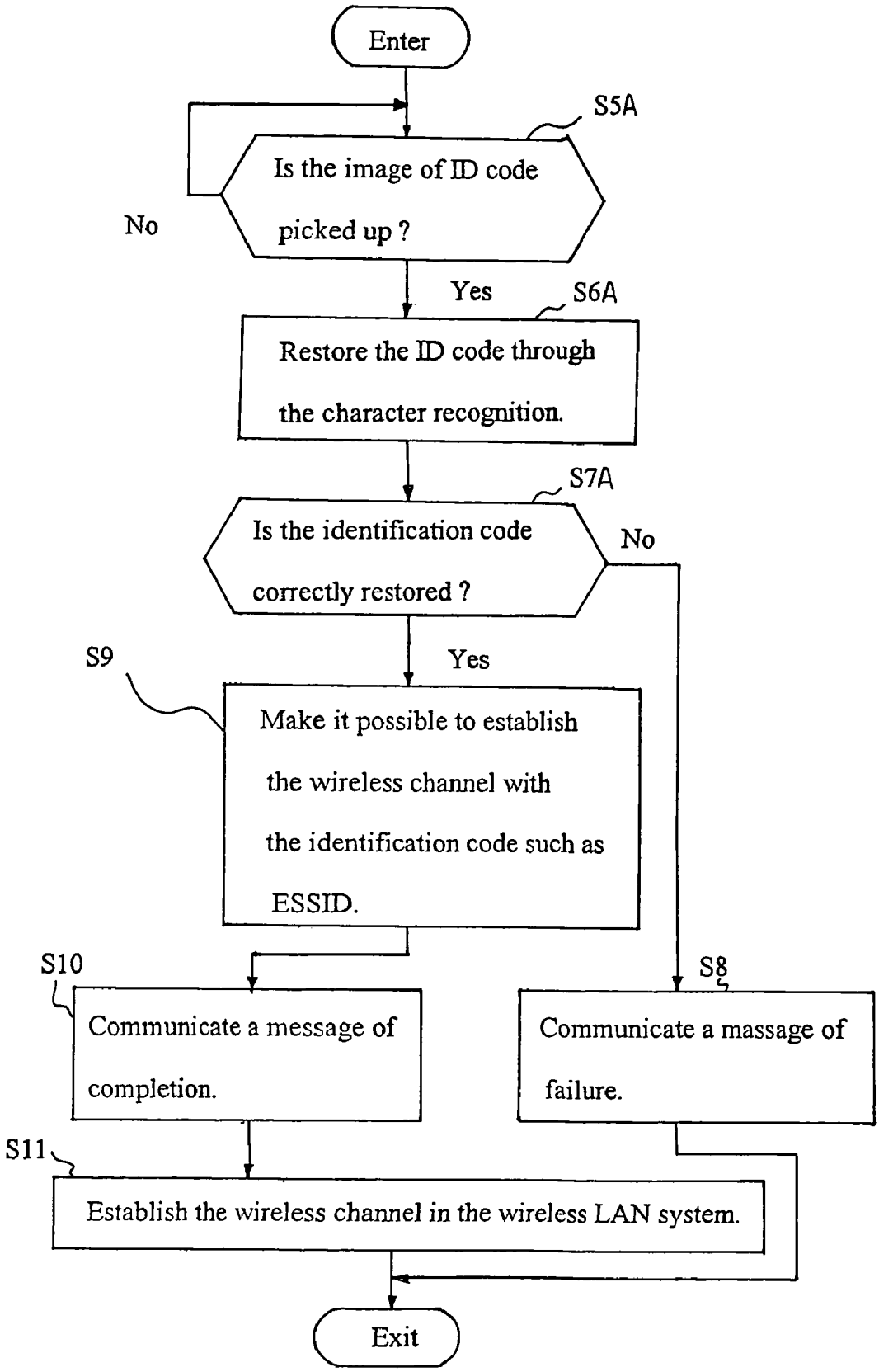
FIG. 11 is a flowchart showing a subroutine program for a pairing work.

A character recognition technique may be employed in a PDA, which forms a part of still another music performance system embodying the present invention. FIG. 10 shows a modification of the musical performance system according to the present invention. When a user wishes to pair an automatic player mute piano 1D with a PDA 2D, the user instructs a controller 1Dj of the automatic player mute piano 1D to produce the character images of an identification code 8D on the display window 14, and takes the character images of identification code 8D into the PDA 2D. Then, the main routine program branches to a subroutine program shown in FIG. 11.

Steps S8 to S11 of the subroutine program are similar to those shown in FIG. 5. For this reason, description is focused on the other steps S5A to S7A. A user is assumed to instruct the PDA 2D to take the character image of identification code 8D thereinto. The central processing unit 20 requests the CCD camera driver 26*a* to supply the driving signal to the high-resolution CCD camera 26A, and fetches the visual data codes from the CCD camera driver 26*a*. Then, the answer at step S5A is given affirmative, and the central processing unit 20 restores the character images 8D to the identification code through a character recognition technique as by step S6A. A suitable subroutine program for the character recognition has been down-loaded from a suitable program source into the PDA 2D or the controller 1D.

Upon completion of the restoration, the central processing unit 20 temporarily stores the identification code, and communicates with the automatic player mute piano 1D through the wireless channel 30*d*. When the central processing unit 20 is successful in the character recognition, the controller 1Dj answers to the request, and the answer at step S7A is given affirmative. On the other hand, if the central processing unit 20 fails to restore the character images to the identification code, the controller 1Dj does not answer so that the answer at step S7A is given negative. Thus, the identifier may be transmitted from the controller 1Dj to the PDA 2D in the form of character images. The subroutine programs shown in FIGS. 6 and 7 also runs on the central processing unit 20 of the PDA 2D.

The PDA may be replaced with a note-size personal computer or a small-size information processing device with a tablet-type interface.

Figure 12:
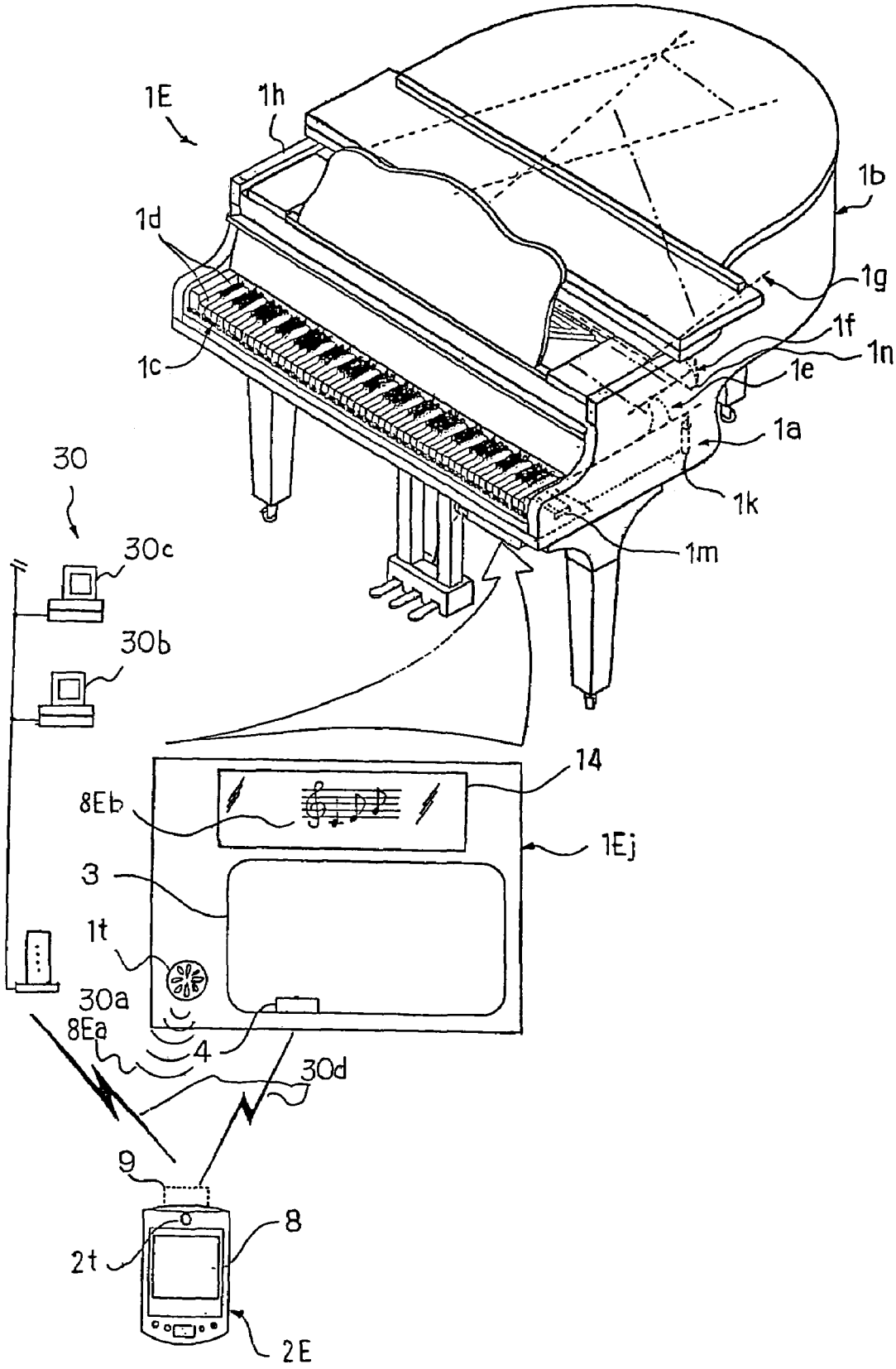
FIG. 12 is a schematic view showing another modification of the musical performance system shown in FIG. 8.

The visual image of an identifier does not set any limit to the technical scope of the present invention. A sound image such as, for example, a series of tones may serve as the identifier. FIG. 12 shows another modification of the musical performance system according to the present invention. The musical performance system largely comprises an automatic player mute piano 1E and a PDA 2E. The automatic player piano 1E is similar to the automatic player piano 1B except for a controller 1Ej so that description is focused on the controller 1Ej. An electronic tone generator (not shown) and a loud speaker 1*t* are further incorporated in the controller 1Ej. The binary numbers and alphabet characters are correlated with tones 8Ea different in pitch, and the relation therebetween are stored in the controller 1Ej and the PDA 2E.

The PDA 2E is similar to the PDA 2 except for a microphone 2*t* and a sample-and-hold circuit (not shown). The pieces of data expressing the correlation have been downloaded into the PDA 2E from a suitable data source (not shown) or the controller 1Ej.

When a user pairs the automatic player mute piano 1E with the PDA 2E, the central processing unit 10 converts the identification code to a series of music data codes as well as a series of visual data codes representative of notes 8Eb on the stuff notation, and supplies the music data codes and visual data codes to the electronic tone generators and display controller 14*a*. The electronic tone generator produces an audio signal from the music data codes, and supplies the audio signal to the loud speaker 1*t*. The audio signal is converted to a series of tones 8Ea through the loud speaker 1*t*, and the tones 8Ea are radiated from the loud speaker 1*t*.

The series of tones 8Ea reaches the microphone 2*t*, and are converted to a series of audio data codes by means of the sample-and-hold circuit. The central processing unit 20 fetches the audio data codes from the sample-and-hold circuit, and stores them in the random access memory 22.

Figure 13:
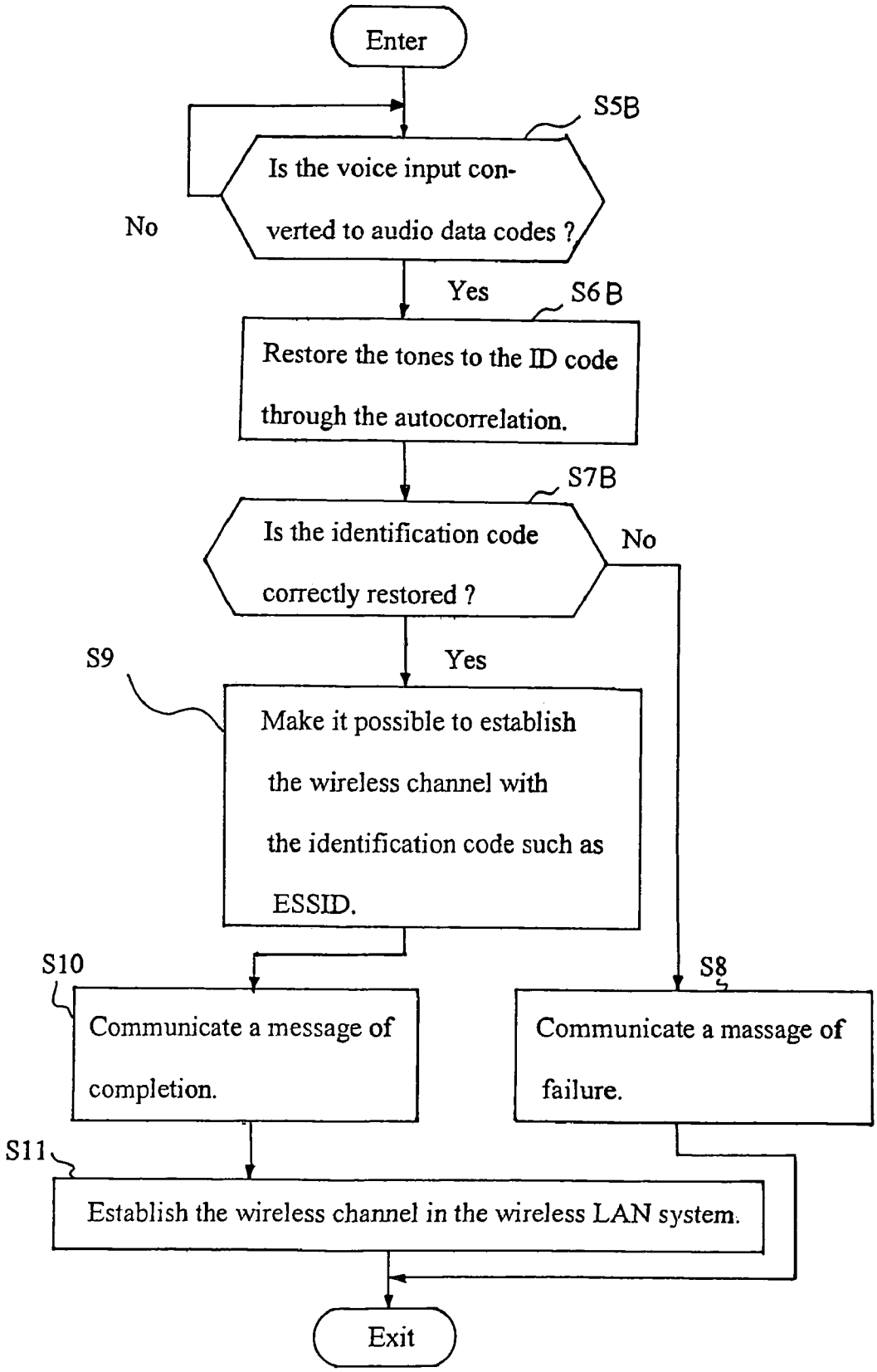
FIG. 13 is a flowchart showing a subroutine program for a pairing work.

The central processing unit 20 checks the random access memory 22 to see whether or not the voice input has been converted to the audio data codes expressing tones as by step S5B (see FIG. 13). In order to determine the pitch, a step of a digital filtering and a step of autocorrelation may be employed in the subroutine program. With the positive answer "Yes", the central processing unit 20 restores the audio data codes to the identification code through the voice recognition technique as by step S6B. When the central processing unit 20 is successful in the voice recognition, the controller 1Ej answers to the request, and the answer at step S7B is given affirmative. On the other hand, if the central processing unit 20 fails to restore the tones to the identification code, the controller 1Ej does not answer so that the answer at step S7B is given negative. Thus, the identifier may be transmitted from the controller 1Dj to the PDA 2D in the form of tones. The subroutine programs shown in FIGS. 6 and 7 also runs on the central processing unit 20 of the PDA 2E.

The system components of the musical performance systems described hereinbefore are correlated with claim languages as follows.

Each of the automatic player mute pianos 1, 1A, 1B, 1C, 1D and 1E serves as a "musical instrument", and the keyboard 1*c*, key action units 1*e*, hammers 1*f*, strings 1*g*, solenoid-operated key actuators 1*k*, electronic tone generator (not shown) and sound system (not shown) as a whole constitute a "tone generator". The identification code or piece of identification data is equivalent to an "identifier". The visual image 8/8A/8B/8C/8D or series of tones is corresponding to a "machine-recognizable image".

The image pickup device 26, high-resolution CCD camera 26A or the combination of the microphone 2*t* and sample-and-hold circuit serves as an "image pickup device", and the central processing unit 20 and instruction codes at steps S5 to S7, S5A to S7A or S5B to S7B as a whole constitute a "converter". The central processing unit 20 and instruction codes at steps S20 to S28 as a whole constitute a "communication device". The QR code serves as a "code". The tones are propagated from the loud speaker 1*t* to the microphone 2*t* as "sound wave".

What is claimed is:

1. A musical performance system for producing music sound, comprising:

at least one musical instrument including a tone generator producing said music sound, and a controller converting an identifier assigned to said at least one musical instrument for discriminating said at least one musical instrument from other musical instrument to an machine-recognizable image, outputting said machine-recognizable image to the outside thereof, communicable through a wireless channel so as to receive an instruction labeled with said identifier and controlling said tone generator on the basis of said instruction for producing said music sound; and a portable information terminal device taking in said machine-recognizable image, restoring said machine-recognizable image to said identifier, and establishing said wireless channel in said musical performance system so as to transmit said instruction labeled with said identifier to said controller.

2. The musical performance system as set forth in claim 1, in which said machine-recognizable image is a visual image so that said portable information terminal device takes in said visual image by means of an image pickup device.

3. The musical performance system as set forth in claim 2, in which said visual image expresses a code equivalent to said identifier.

4. The musical performance system as set forth in claim 2, in which said visual image expresses characters expressing said identifier.

5. The musical performance system as set forth in claim 1, in which said machine-recognizable image is output from said controller in the form of sound wave so that said portable information terminal device takes in said sound wave by means of a microphone.

6. The musical performance system as set forth in claim 5, in which said sound wave is recognized as a series of tones.

7. The musical performance system as set forth in claim 1, in which said at least one musical instrument is a hybrid musical instrument having an acoustic musical instrument and an electronic system.

8. The musical performance system as set forth in claim 7, in which said electronic system includes an array of solenoid-operated actuators for driving keys of said acoustic musical instrument.

9. The musical performance system as set forth in claim 7, in which said hybrid musical instrument further has a stopper prohibiting said tone generator from producing said music sound.

10. A musical instrument forming a part of a musical performance system together with a portable information terminal device, comprising:

a tone generator producing music sound; and a controller converting an identifier assigned to said musical instrument for discriminating said at least one musical instrument from other musical instrument to an machine-recognizable image, outputting said machine-recognizable image to the outside thereof, communicable through a wireless channel with said portable information terminal device so as to receive an instruction labeled with said identifier restored from said machine-recognizable image in said portable information terminal device, and controlling said tone generator on the basis of said instruction for producing said music sound.

11. The musical instrument as set forth in claim 10, in which said controller produces a visual image as said machine-recognizable image.

12. The musical instrument as set forth in claim 11, in which said visual image is recognized as a code equivalent to said identifier.

13. The musical instrument as set forth in claim 11, in which said visual image is recognized as characters expressing said identifier.

14. The musical instrument as set forth in claim 10, in which said controller produces sound wave as said machine-recognizable image.

15. The musical instrument as set forth in claim 10, in which said tone generator includes a keyboard having plural keys, plural key action units respectively linked with said plural keys, plural hammers driven for rotation by said plural key action units and plural strings struck with said plural hammers at the end of said rotation.

16. The musical instrument as set forth in claim 15, in which said tone generator further includes plural solenoid-operated key actuators selectively energized by said controller so as to give rise to the key motion without any fingering of a human player.

17. The musical instrument as set forth in claim 15, further comprising a hammer stopper provided between said plural hammers and said plural strings and moved into and out of trajectories of said hammers.

18. A portable information terminal device forming a part of a musical performance system together with at least one musical instrument having a controller, comprising:

an image pickup device taking in a machine-recognizable image representative of an identifier assigned to said at least one musical instrument for discriminating said at least one musical instrument from other musical instrument and output from said at least one musical instrument;

a converter restoring said machine-recognizable image to said identifier, and a communication device establishing a wireless channel in said musical performance system so as to transmit an instruction labeled with said identifier to said controller, whereby a user controls said at least one musical instrument.

19. The portable information terminal device as set forth in claim 18, in which said image pickup device is a camera through which a visual image is taken into said portable information terminal device as said machine-recognizable image.

20. The portable information terminal device as set forth in claim 18, in which said image pickup device is a microphone through which sound wave is taken into said portable information terminal device as said machine-recognizable image.

* * * * *